US008193988B2

(12) United States Patent
Thudor et al.

(10) Patent No.: US 8,193,988 B2
(45) Date of Patent: Jun. 5, 2012

(54) VERSATILE ANTENNA SYSTEM

(75) Inventors: Franck Thudor, Rennes (FR); Françoise Le Bolzer, Rennes (FR); Corinne Nicolas, La Chapelle des Fougeretz (FR)

(73) Assignee: Thomson Licensing, Boulogne-Billancourt (FR)

( * ) Notice: Subject to any disclaimer, the term of this patent is extended or adjusted under 35 U.S.C. 154(b) by 213 days.

(21) Appl. No.: 11/919,770

(22) PCT Filed: May 3, 2006

(86) PCT No.: PCT/FR2006/050409

§ 371 (c)(1),
(2), (4) Date: Nov. 1, 2007

(87) PCT Pub. No.: WO2007/000520

PCT Pub. Date: Jan. 4, 2007

(65) Prior Publication Data

US 2009/0085821 A1 Apr. 2, 2009

(30) Foreign Application Priority Data

May 3, 2005 (FR) ..... 05 51166

(51) Int. Cl.
*H01Q 1/38* (2006.01)

(52) U.S. Cl. ..... 343/700 MS; 343/893

(58) Field of Classification Search ..... 343/700 MS, 343/767, 795, 819, 893
See application file for complete search history.

(56) References Cited

U.S. PATENT DOCUMENTS

| | | | | |
|---|---|---|---|---|
| 6,031,503 | A * | 2/2000 | Preiss et al. | 343/770 |
| 6,583,765 | B1 * | 6/2003 | Schamberger et al. | 343/770 |
| 6,873,293 | B2 * | 3/2005 | Proctor et al. | 343/702 |
| 7,034,761 | B2 * | 4/2006 | Chiang et al. | 343/745 |
| 2003/0043078 | A1 * | 3/2003 | Deng et al. | 343/700 MS |
| 2010/0029197 | A1 * | 2/2010 | Judd et al. | 455/11.1 |

FOREIGN PATENT DOCUMENTS

| | | | |
|---|---|---|---|
| GB | 841335 | | 7/1960 |
| JP | 10-004313 | A | 1/1998 |
| JP | 2002-152076 | | 5/2002 |
| JP | 2003-087022 | A | 3/2003 |
| JP | 2003-124728 | | 4/2003 |
| JP | 2004-015460 | A | 1/2004 |
| WO | WO 01/024407 | * | 5/2001 |

OTHER PUBLICATIONS

Patent Abstracts of Japan, vol. 2003, No. 8, Aug. 6, 2003 & JP 2003-124728.
Patent Abstracts of Japan, vol. 2002, No. 9. Sep. 4, 2002 & JP 2002-152076.
Search Report Dated Dec. 18, 2006.

* cited by examiner

*Primary Examiner* — Kyana R McCain
(74) *Attorney, Agent, or Firm* — Tutunjian & Bitetto, P.C.

(57) ABSTRACT

The present invention relates to an antenna system designed to be used in a wireless link, having polarization directions, respectively for reception and emission, identical to the polarization directions, respectively for emission and reception, presented by a similar system placed in a geometric configuration of use that is different from that of the said first system. The invention enables identical devices to be implemented in separate items of equipment and in distinct positions while enabling the antenna pair to function correctly.

13 Claims, 4 Drawing Sheets

VERSATILE ANTENNA SYSTEM

This application claims the benefit, under 35 U.S.C. §365 of International Application PCT/FR2006/050409, filed on May 3, 2006, which was published in accordance with PCT Article 21(2) on Jan. 4, 2007 in French and which claims the benefit of French patent application No. 05 51166 filed on May 3, 2005.

The present invention relates to an antenna system designed to be used on a wireless link, more particularly in a domestic environment for high bitrate video transmission. Such systems must have topologies integrating diversity.

Such situations are encountered in the field of digital television where this involves linking a screen and a front end box, for example, using a wireless link.

Hence, this involves implementing a wireless link in two items of equipment having different geometries and orientations but being part of the same product. The integration constraints of a radiating device are largely dictated by the geometry and arrangement of the equipment: this conditions the choice of the antenna type. Now, as such antennas are polarised, two different configurations of use, for example, on two items of equipment of a same product, most frequently give rise to the use of two different radiating device structures. This generates development and production costs, as distinct devices must be developed.

The present invention proposes a type of antenna system being able to be used according to diverse geometric configurations such that the systems integrated into two items of equipment presenting different geometric constraints can be identical.

The present invention relates to an antenna system for wireless link operating in transmission and reception comprising at least two radiating elements with a first radiating element operating in reception (Rx) according to a first direction of polarization and a second radiating element operating in transmission (Tx) according to a second direction of polarization. In this case, the first and second radiating elements are positioned next to each other so that a first antenna system operates with a second identical antenna system, oriented in parallel or at 90° in relation to the first antenna system.

By enabling the polarization directions used in reception and in emission in two geometrically distinct configurations of a same antenna system to be conserved, the invention allows the same system to be used in equipment with distinct geometric constraints. This limits the development and production costs since only one structure is necessary.

According to one embodiment, the radiating elements are realized on a first rigid substrate comprising a layer of flexible material extending beyond the part receiving the radiating elements, the flexible material layer comprising a second rigid substrate at its other extremity.

Such a system can be integrated into two items of equipment with distinct geometric constraints without having to modify the structure of the antenna system itself.

In one embodiment, the layer of flexible material constitutes an internal layer of the rigid substrates.

In one embodiment, three distinct radiating elements are used, one for transmission and two for reception.

This embodiment resolves a well known problem of wireless links in a domestic environment (intra-building or indoor links) that suffer from deteriorations in the propagation channel related to the phenomenon of multiple paths or multipaths which arise from the reflections of the signal on obstacles (walls, furniture, etc.). Moreover, it is also observed that this channel can vary over time according to the movement of people in the house for example. Fluctuations at the signal level received thus take place according to the constructive or destructive combinations of the paths. To overcome this problem, those skilled in the art know how to use two reception antennas in such a manner at to integrate a spatial, polarization or radiation diversity for reception.

According to a first embodiment, the radiating elements radiate in the plane of the first rigid substrate on which they are integrated, the radiating element being realised using printed circuit technology, for example of the slot, Vivaldi, printed dipole, Yagi dipole type.

According to a second embodiment, the radiating elements radiate in a perpendicular plane to the plane of the first rigid substrate on which they are integrated, the radiating elements can be realised using a technology chosen from among the printed circuit, dielectric, ceramic, 3D metal technologies.

In one characteristic of the invention, when the first and second polarization directions are perpendicular, the second antenna system is oriented at 90° in relation to the first antenna system.

Such an antenna topology can be integrated easily into an item of equipment. The orthogonality of the polarization between the transmission and reception is used in such a manner as to be able to match this antenna solution on items of equipment having different orientations (typically horizontal: Front End Box) and vertical (plasma screen). Indeed, for the high bitrate links that interest us, the link between the two items of equipment is most often in direct view. This means that the link is optimum if the polarization of the transmission antenna of the first item of equipment is identical to that of the reception antenna of the second item of equipment and vice versa.

According to one embodiment, the radiating elements are chosen here among the waveguides, microstrip patches, dipoles, radiating slots, the waveguides being able to be produced from tinned stamped metal or a plastic moulding with metal inserts and also being able to be square.

Other characteristics and advantages of the present invention will emerge on reading the description of different non-restrictive embodiments, the description being made with reference to the annexed drawings wherein:

FIG. 1*a* and 1*b* diagrammatically show a radiating device according to one embodiment of the invention in two distinct geometric configurations.

Figure 4A:
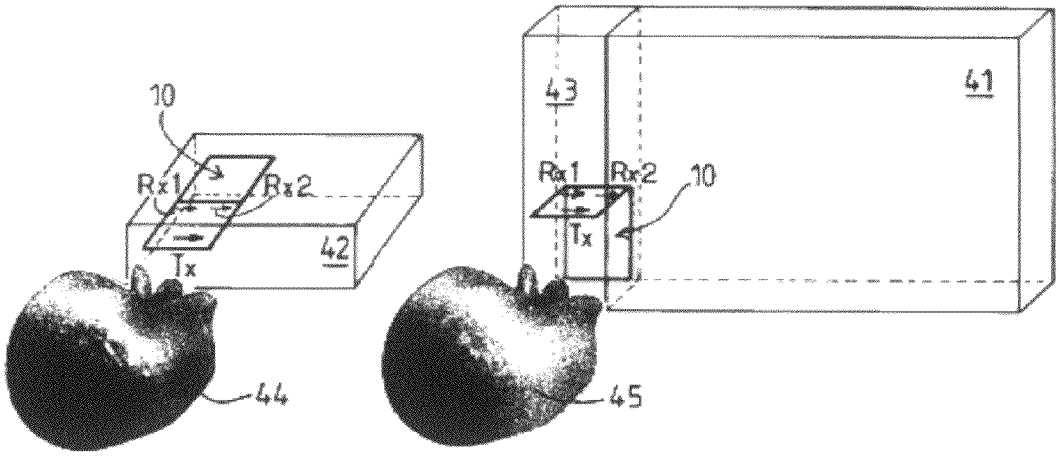
Figure 4B:
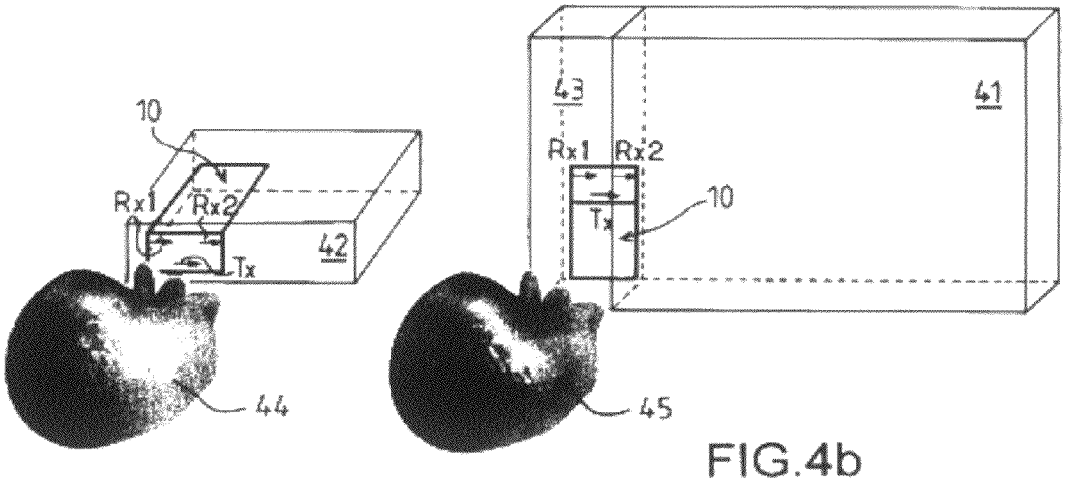

FIG. 4*a* and 4*b* diagrammatically show wireless links realised using radiating devices according to the embodiment of FIG. 1, respectively for devices comprising radiating elements with longitudinal and transversal radiation.

Figure 5:
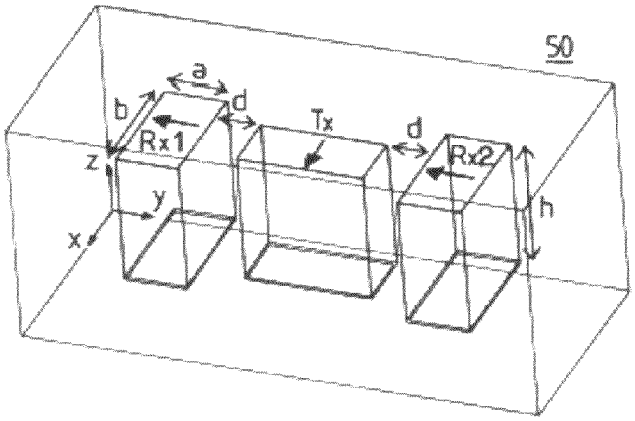

FIG. 5 diagrammatically shows a radiating device according to another embodiment of the invention.

Figure 6:
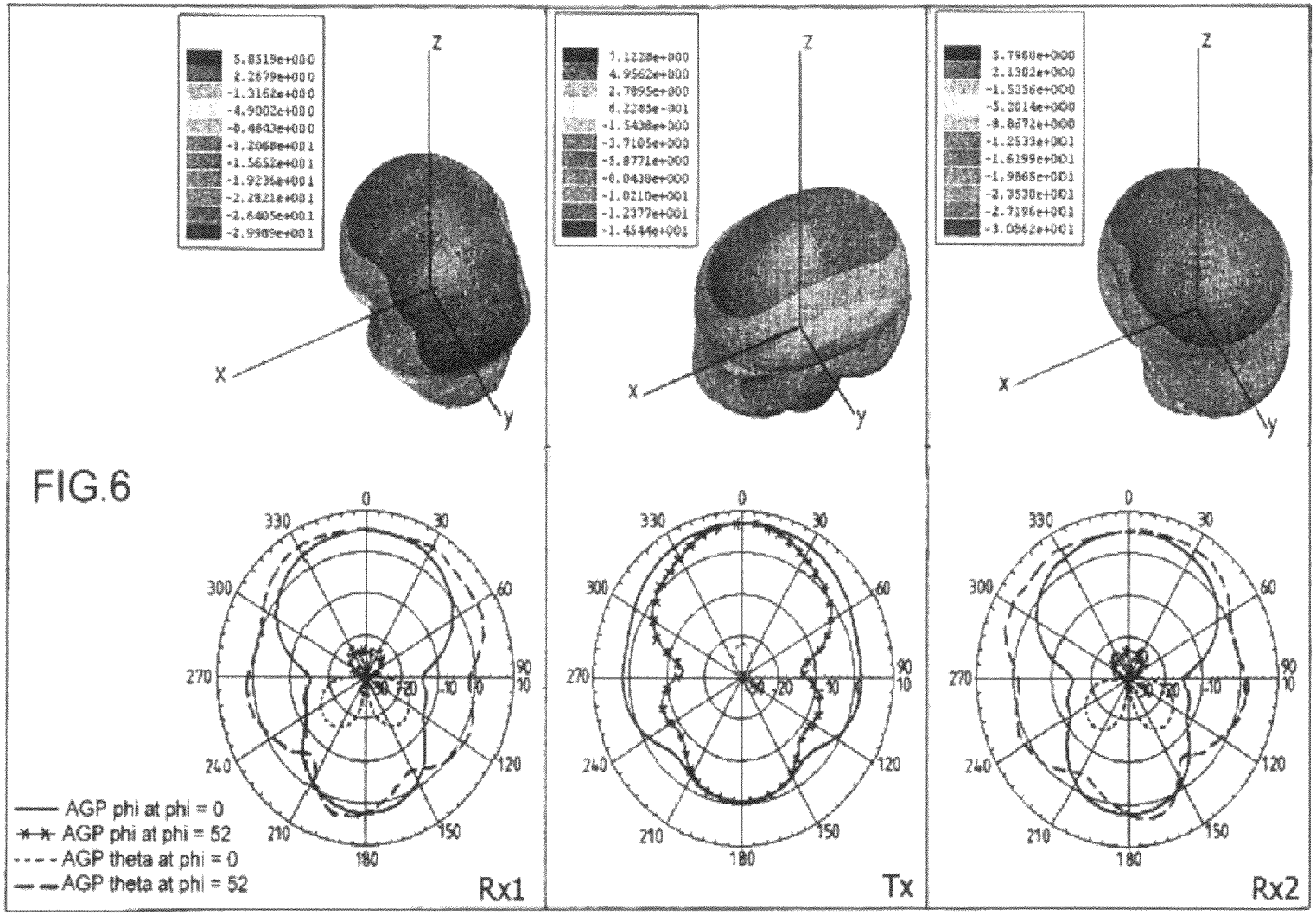

FIG. 6 shows the 3D and 2D radiation patterns obtained for each waveguide of the radiating device of FIG. 5.

Figure 7:
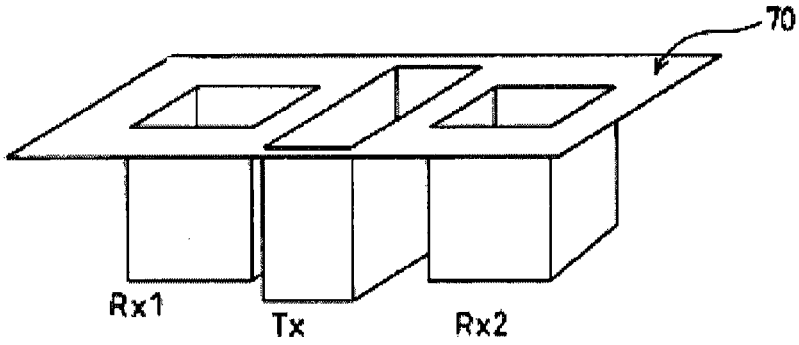

FIG. 7 is a diagram of a radiating device according to the embodiment of FIG. 5 and shielded.

Figure 8:
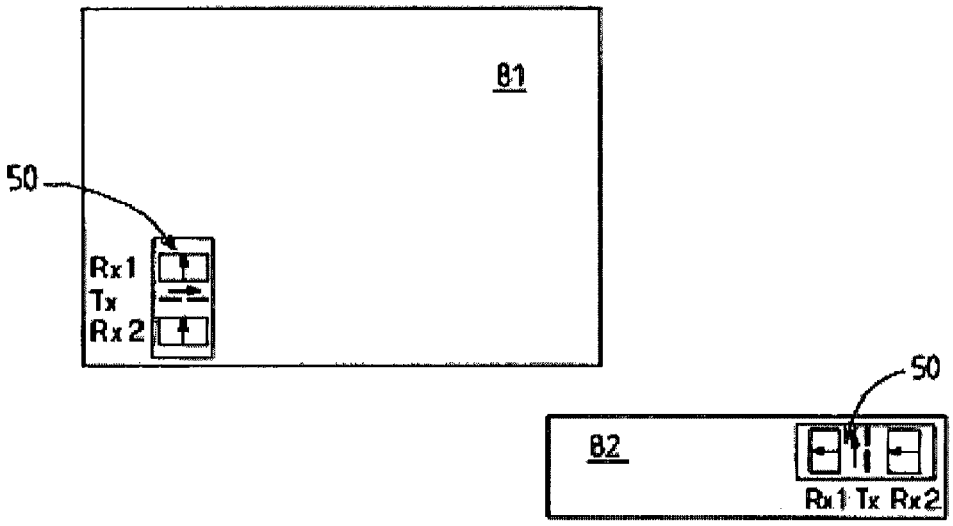

FIG. 8 diagrammatically shows a wireless link produced using the radiating devices according to the embodiment of FIG. 5.

FIG. 1 shows an antenna system 10 according to one embodiment of the invention. The system 10 includes three radiating elements (Rx1, Rx2, Tx) integrated on a first rigid substrate 11 and a control circuit of these radiating elements integrated on a second rigid substrate 12. The control circuit typically includes microwave and base band functions and digital functions. The system 10 includes a flexible material layer 13 between both rigid plane substrates 11 and 12. One or more microstrip lines 14 are integrated on this flexible portion 13 in such a manner as to create the connections between the rigid substrates 11 and 12. The flexible portion 13 can be used to modify the geometric configuration of the device 10 by folding the flexible layer 13 while maintaining a constant position of the rigid substrate 11 on which the radiating elements are integrated. The rigid substrates 11 and 12 are advantageously flat and can have attachment means such as clips or even grooves.

The rigid material layers are for example made of low cost materials such as the FR4 type materials. The flexible material layer(s) can be made of a Kampton type material and also constitute the internal layers of the rigid substrates 11 and 12. This last characteristic can prevent the discontinuities of lines between the functions provided on each of the rigid substrates 11 and 12. Other flexible materials, like plastic materials such as Polyethylene Terephtalate (PET) or Polybutylene Terephtalate (PBT) or the derived polyesters of the Thermoplastic Elastomer (TPE) type, are also compatible with use in a device according to the invention.

The use of the flexible material offers great flexibility in the use and positioning of the antenna system 10 by keeping the polarization directions that are suitable for a given wireless link.

The operation obtained in the two configurations proposed in the FIG. 1 was simulated using the HFSS 3D electromagnetic modelling software (Ansoft). For this, the rigid material chosen is of the FR4 type (Er=4.4; tan delta=0.023; h=0.54 mm), the flexible material is of the Kapton type (Er=3.5; tan delta=0.009; h=0.075 mm). A microstrip line of characteristic impedance 50 ohms was simulated. The width of the 50 ohms microstrip line is equal to 0.14 mm at the level of the rigid substrates of the circuit parts and radiating elements and to 0.185 mm at the level of the flexible material alone.

Figure 1A:
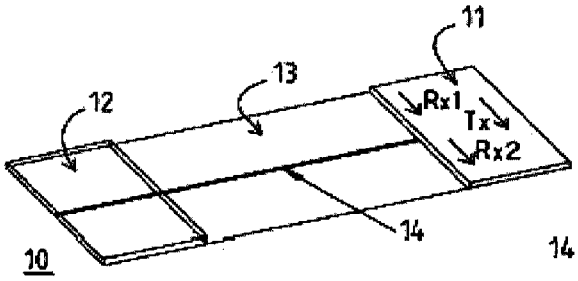
Figure 1B:
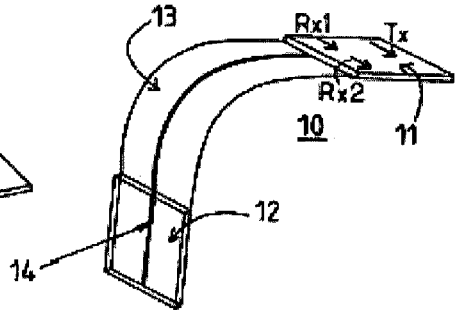
Figure 2:
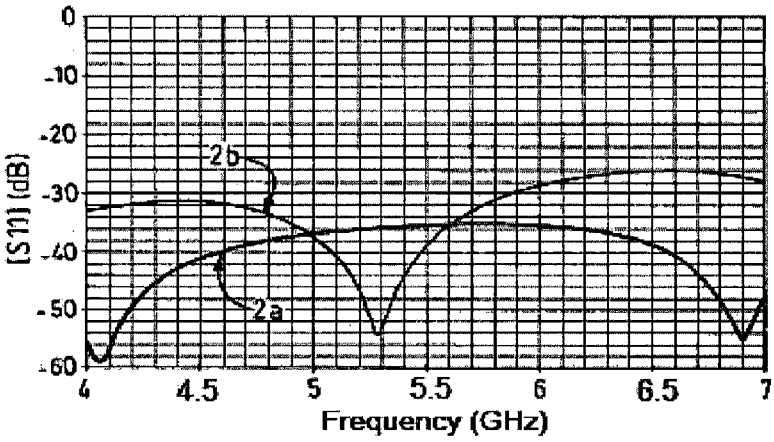
FIG. 2 shows two curves indicating the reflection coefficient of the radiating device in both configurations of FIGS. 1*a* and 1*b*.
Figure 3:
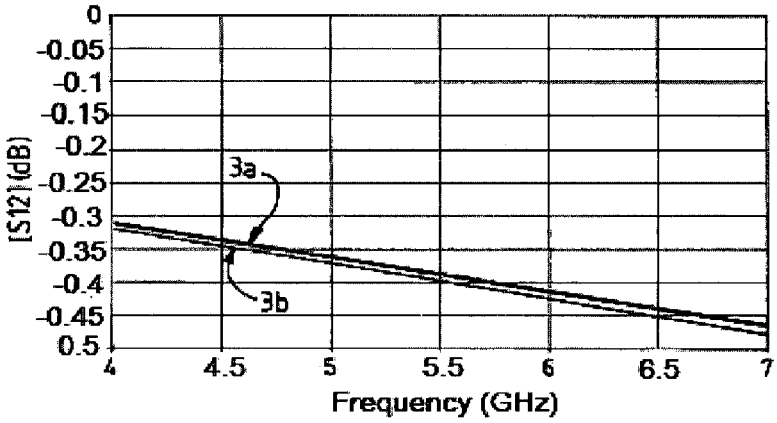
FIG. 3 shows two curves indicating the insertion losses obtained with the radiating device in both configurations of FIGS. 1*a* and 1*b*.

The results obtained in terms of impedance matching and insertion loss are shown in FIGS. 2 and 3. The curve 2*a* represents the reflection coefficient observed for the flat system of FIG. 1*a* and the curve 2*b* represents the reflection coefficient observed for the folded system of FIG. 1*b*. The curve 3*a* shows the insertion losses observed for the flat device of FIG. 1*a* and the curve 3*b* shows the insertion losses observed for the folded device of FIG. 1*b*. It is therefore verified that, in the frequency domain wherein the antenna system of the present invention is required to operate, the mechanical force imposed on the flexible substrate does not deteriorate the impedance matching or the insertion losses. Indeed, the reflection coefficient is very low in both cases (<−25 dB) which means that almost all of the energy injected at one extremity of the line is efficiently transmitted to the other extremity. Likewise, it is noted that the insertion losses are very low (<0.3 dB) in both line configurations, which means that hardly any energy is dissipated along this line.

FIGS. 4*a* and 4*b* show two examples of use of a wireless connection realized between a plasma screen 41 to play videos and a front end box using a pair of antenna systems 10 according to the invention. The video content processing is varied and goes from the digital reception of emissions coming from a cable or satellite decoder or even a server. The front end box can be distant from the screen and located either in the same room or in a neighbouring room. A wireless link is therefore particularly suited to such an application. By its nature, the plasma screen is very flat, fitted on a wall or placed on a base in vertical position whereas the front end box is parallelepiped shaped and used in a horizontal position. The characteristics of plasma screens and front end boxes are such that their geometric dimensions extend in perpendicular dimensions. As it is preferable that the installation of an antenna system necessary for the implementation of the wireless link does not involve increasing the dimensions of these two technical elements, the invention finds an application here.

In FIG. 4*a*, three distinct radiating elements are integrated: one for transmission Tx and two for reception Rx1 and Rx2, the arrows representing the directions of the linear polarizations used. The use of two radiating elements for reception enables an order 2 diversity diagram for reception to be obtained. The wave emitted by the three radiating elements has a horizontal linear polarization and a longitudinal radiation that is in the plane of the substrate, as shown in the radiation patterns 44 and 45 diagrammatically shown in the figure. In such a case, the antenna system, as shown in FIG. 1*a*, can be placed horizontally on the front end box without any folding constraint. However, for the screen, an identical antenna system must extend its dimensions in the vertical direction given the low thickness of the screen. An identical system is then placed vertically, but to ensure compatibility in terms of radiation and polarization, this positioning requires the system to be bent in such a manner as to bring the rigid substrate integrating the radiating elements to the horizontal, as shown in FIG. 1*b*. The space available to fit such a device is for example found at the level of the loudspeaker 43. The polarization directions are then compatible for emission and reception.

The radiating elements having a longitudinal radiation are advantageously realized using printed technology and correspond for example to structures of the Vivaldi, printed dipole, printed Yagi type, etc.

FIG. 4*b* shows another example wherein transversal radiation radiating elements are used, namely in the perpendicular plane to the substrate, as shown by the radiation patterns 44 and 45 diagrammatically shown in FIG. 4*b*. The configuration of the wireless link then changes. The system requiring folding is then arranged on the front end box and another system is placed vertically flat on the screen.

The radiating elements presenting a transversal radiation can be realised using printed technology (patch, annular slot antenna, etc.), dielectric or ceramic (DRA: Dielectric Resonator Antenna, etc), 3D metal (PIFA: Planar Inverted F Antenna, wave guides, etc.).

FIG. 5 shows an antenna system 10 according to another embodiment of the invention. In this embodiment the system comprises at least two radiating elements, one for reception Rx and one for transmission Tx having polarization directions oriented at 90° from each other. In FIG. 5, three radiating elements are shown, two for reception Rx1 and Rx2 and one for transmission Tx. A diversity diagram in the order of 2 for reception is thus obtained. The wave emitted by the radiating element Tx has a polarization perpendicular to the wave received by the radiating elements Rx. Hence, it is possible to realize a wireless link between such systems by turning one of the systems through 90° in relation to the other. This allows the same system to be used in objects of varied geometry while respecting the direction of the polarizations for reception and emission.

In FIG. 5, the radiating elements are shown in open waveguide technology. Such a structure can be produced using tinned stamped metal, plastic moulding or duplicate moulding with metal inserts realized in folded sheet metal, for example. The moulding can be realized advantageously at the same time as the screen boxes and/or front end box. However, they can be produced using diverse technologies such as printed technology (patches, dipoles, radiating slots, etc.), wire-base technology, etc. Several of the said technologies can also be used in a same device: for example, rectangular wave guides for reception and a dipole for transmission. It is also possible to use square waveguides instead of rectangular waveguides to add a polarization diversity diagram.

A system as shown in FIG. 5 was simulated by using the HFSS software of the Ansoft company, based on the finite element method. It comprises three identical rectangular open waveguides of dimensions a=18 mm, b=36 mm, h=40 mm arranged next to each other. The distance between each guide is d=13 mm. The total size is therefore 98 mm×36 mm×40 mm. This is compatible with many applications in which wireless links are useful.

The radiation patterns obtained for an operation at 5,500 MHz are presented in FIG. 6. They are compliant with those obtained for an open waveguide taken separately, with a slight deformation of the radiation patterns of the guide Rx1 due to the presence of the second guide Rx2 and vice versa.

As shown in FIG. 7, it is possible to position an additional shielding 70 between the waveguides of FIG. 5 to prevent electromagnetic leaks and obtain good electromagnetic compatibility. This shielding 70 is constituted by a plate on which the waveguides are placed.

FIG. 8 shows an example of use of a system 50 as shown in FIG. 5. In the screen 81, the device 50 is placed vertically whereas it is positioned horizontally in the front end box 82.

Hence, the invention enables a same model of antenna systems to be used for many applications of diverse geometries without modifying the dimensions of the objects on which a wireless link is implemented. The invention thus has a great versatility of applications for the radiating devices obtained. The implementation of wireless links is therefore facilitated. It is noted that the development and production costs of such links are low thanks to the invention. Moreover, materials widely used in general public products can be used in the radiating devices according to the invention and this reduces the cost of the solution accordingly.

The invention is not limited to the embodiments described and those skilled in the art will recognise the existence of different embodiment variants such as for example the use of a diversity diagram of varied radiating elements, diverse design possibilities of the rigid and flexible parts, the only constraint consisting in finding the dimensions of the radiating device compatible with the integration zones of the solution, diverse applications as panel displays, for example in airports and stations, etc.

The invention claimed is:

1. An antenna for wireless communication operating in transmission and reception comprising at least two omnidirectional radiating elements with a first radiating element operating in reception according to a first direction of polarization and a second radiating element operating in transmission according to a second direction of polarization, wherein the first and second radiating elements are realized next to each other on a same end of a same surface of a first substrate and radiate in the plane of the said first substrate in the same direction, wherein a first antenna system having the antenna operates with a second identical antenna system having the antenna and being oriented in parallel or at 90° in relation to the first antenna system, said first and second radiating elements being oriented so that the first radiating element of the antenna of the first antenna system co-operates with the second radiating element of the antenna of the second identical operating system and the second radiating element of the antenna of the first antenna system co-operates with the first radiating element of the antenna of the second identical antenna system such that the polarization directions used in reception and in emission in two geometrically distinct configurations of said antennae of the first and second antenna systems being conserved.

2. System according to claim 1, wherein the first substrate comprises a layer of flexible material extending beyond a rigid part receiving the radiating elements, the flexible material layer comprising a second rigid substrate at its other extremity.

3. System according to claim 2, wherein the layer of flexible material constitutes an internal layer of the rigid substrates.

4. System according to claim 1, wherein the radiating elements are realized using printed circuit technology.

5. System according to claim 4, wherein the radiating elements have a structure chosen from among the slot, Vivaldi, printed dipole, Yagi dipole types.

6. System according to claim 1, wherein when the first and second polarization directions are perpendicular, the second antenna system is oriented at 90° in relation to the first antenna system.

7. System according to claim 6, wherein the radiating elements are chosen from among the waveguides, microstrip patches, dipoles, radiating slots.

8. System according to claim 1, wherein it comprises three radiating elements with two radiating elements operating at reception surrounding a radiating element operating at emission.

9. An antenna for wireless communication operating in transmission and reception comprising at least two omnidirectional radiating elements with a first radiating element operating in reception according to a first direction of polarization and a second radiating element operating in transmission according to a second direction of polarization, wherein the first and second radiating elements are realized next to each other on a same end of a same surface of a first substrate and radiate in the plane perpendicular to the plane of the said first substrate, wherein a first antenna system having the antenna operates with a second identical antenna system having the antenna and being oriented in parallel or at 90° in relation to the first antenna system, said first and second radiating elements being oriented so that the first radiating element of the antenna of the first antenna system co-operates with the second radiating element of the antenna of the second identical operating system and the second radiating element of the antenna of the first antenna system co-operates with the first radiating element of the antenna of the second identical antenna system such that the polarization directions used in reception and in emission in two geometrically distinct configurations of said antennae of the first and second antenna systems being conserved.

10. System according to claim 9, wherein the radiating elements are realised using a technology chosen from among the printed circuit, dielectric, ceramic, 3d metal technologies.

11. System according to claim 9, wherein the first substrate comprises a layer of flexible material extending beyond a rigid part receiving the radiating elements, the flexible material layer comprising a second rigid substrate at its other extremity.

12. System according to claim 9, wherein when the first and second polarization directions are perpendicular, the second antenna system is oriented at 90° in relation to the first antenna system.

13. System according to claim 9, wherein it comprises three radiating elements with two radiating elements operating at reception surrounding a radiating element operating at emission.

* * * * *